US005183228A

United States Patent [19]

Curry

[11] Patent Number: 5,183,228

[45] Date of Patent: Feb. 2, 1993

[54] DEVICE FOR COMPARTMENTALIZING A CONTAINER

[76] Inventor: Shawn Curry, 709 Webster St., New Orleans, La. 70118

[21] Appl. No.: 711,680

[22] Filed: Jun. 6, 1991

[51] Int. Cl.[5] ..... B65B 67/04

[52] U.S. Cl. ..... 248/100; 248/95; 248/99

[58] Field of Search ..... 248/95, 97, 99, 100, 248/101, 286, 690; 211/12, 71; 220/404; 209/702

[56] References Cited

U.S. PATENT DOCUMENTS

| | | | |
|---|---|---|---|
| 452,216 | 5/1891 | Davnie . | |
| 1,322,445 | 11/1919 | Hyer | 248/99 X |
| 3,995,924 | 12/1976 | Jones | 248/95 |
| 4,750,638 | 6/1988 | Sosower | 220/404 |
| 4,948,075 | 8/1990 | Allen | 248/95 |

FOREIGN PATENT DOCUMENTS

| | | | |
|---|---|---|---|
| 23314 | of 1911 | United Kingdom | 248/286 |

*Primary Examiner*—Blair M. Johnson
*Attorney, Agent, or Firm*—Keaty & Keaty

[57] ABSTRACT

The invention relates to a device for compartmentalizing a container, such as for example, a garbage bin, into a plurality of individual compartments. The device has an elongated bar, to the middle portion of which a pair of transverse arms is hingedly attached. Each outermost end of the elongated bar and of the transverse arms carries a telescopically slidingly engaged extension member to allow adapting the device to different sizes of the containers. Each extension member carries a flexible resilient clip which allows suspension of the device from a rim of the container.

17 Claims, 1 Drawing Sheet

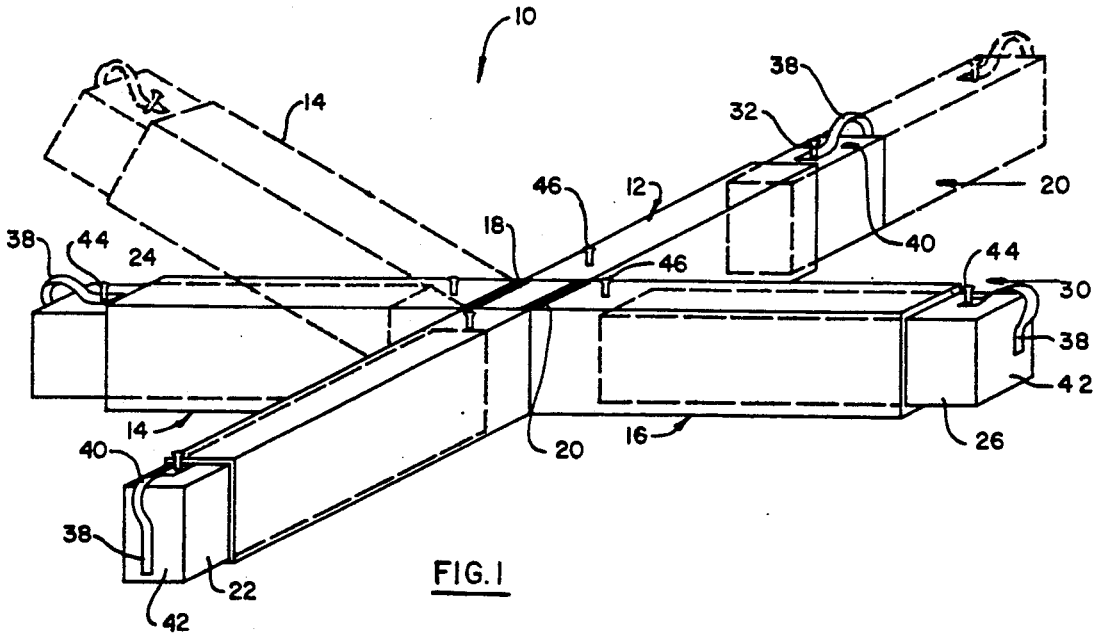
FIG. 1
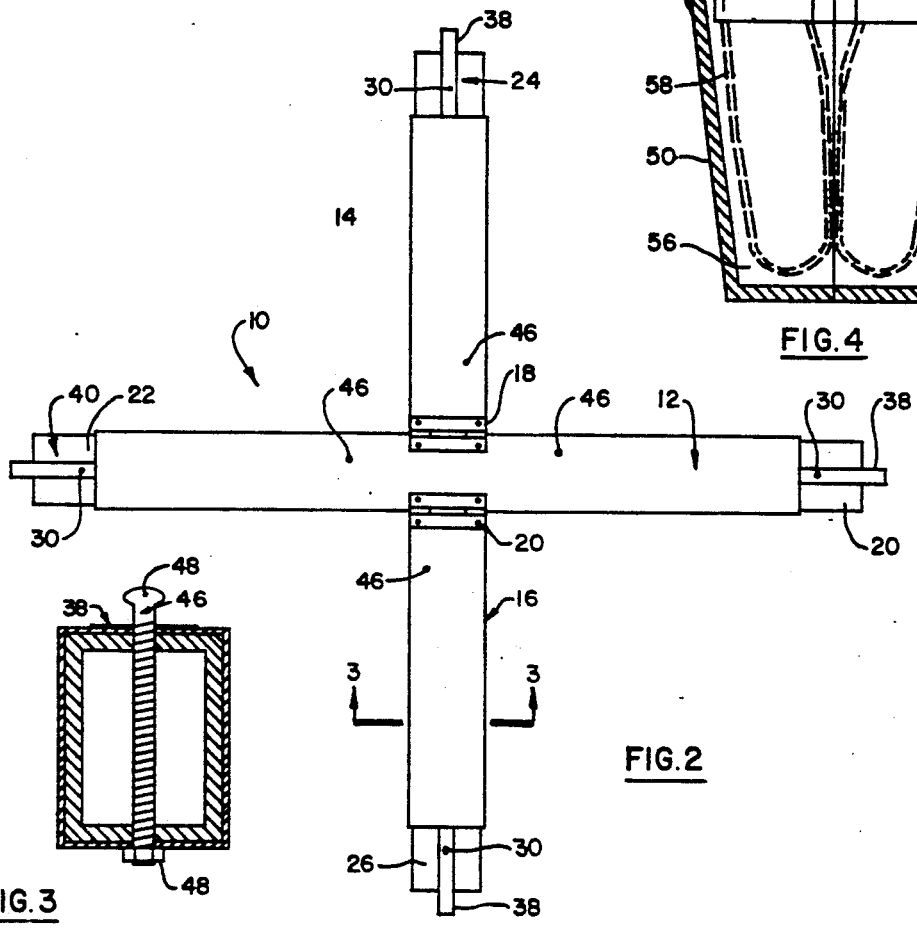
FIG. 2
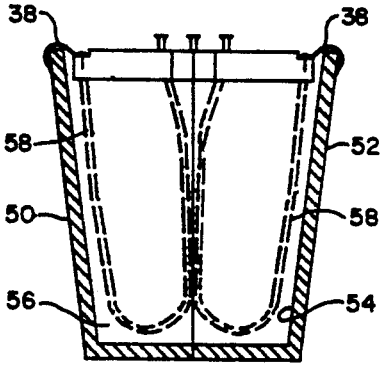
FIG. 4
FIG. 3

DEVICE FOR COMPARTMENTALIZING A CONTAINER

BACKGROUND OF THE INVENTION

This invention relates to dividing devices, and more particularly, to devices for compartmentalizing a container, which has an open top and a continuous side wall, into a plurality of individual compartments.

It has been a continuous concern of environmentalists to encourage average consumer to recycle various household items which are normally disposed of without regard to a possibility of recycling many items, if only they had been properly divided by categories in an average household.

Usually, an average consumer places all disposed of items, such as aluminum cans, glass bottles, plastic, paper, etc. in one garbage bag which is then picked up by a waste collection service and disposed of at a landfill. Such method of disposal not only overburdens already overloaded landfills, but prevents retrieval of items which can be currently recycled with methods known in the recycling industry.

The present invention contemplates provision of a simple, easy to use device for compartmentalizing a disposal or garbage can, so as to allow disposal of items by categories and subsequent recycling of at least a part thereof.

SUMMARY OF INVENTION

It is therefore an object of the present invention to provide a device for compartmentalizing a container.

It is another object of the present invention to provide a device which is simple, inexpensive and easy to use.

It is a further object of the present invention to provide a device which can be adapted for use with different diameter and size containers.

It is still a further object of the present invention to provide a device for compartmentalizing a container to allow separate collection of recyclable items.

These and other objects of the invention are achieved through a provision of a device which comprises an elongated bar having open opposite ends and a pair of transverse arms secured in a perpendicular relationship to a middle portion of the elongated bar, on opposite sides thereof. Each of the opposite ends of the elongated bar and of the transverse arms is provided with extension means to allow extension of longitudinal dimensions of the elongated bar and the transverse arms to accommodate the device for use with larger diameter or size containers.

The extension means comprise an extension member which is telescopically slidingly received within open ends of the elongated bar and of the transverse arms and which slides outwardly to contact the inner wall of the container.

The device is further provided with means for securing the device on a top rim of the container. The securing means comprises a curved a flexible resilient clip which is attached by one of its portions to a top surface of the extension member and which curves (in its second portion) downwardly, so as to contact, by its second portion, the outermost surface of the extension member. By forcing the rim of the container between the outermost surface of the extension member and the second portion of the clip, the device is positioned to suspend from the top rim of the container.

Each extension member is provided with means for limiting sliding movement of the extension member in relation to the elongated bar and the transverse arms.

The movement limiting means comprise a bolt which extends perpendicularly to a longitudinal axis of the extension member substantially through the extension member and is secured in its position by a nut which contacts the under surface of the extension member. The transverse arms are hingedly attached to the longitudinal bar and can be pivoted, to a limited degree, about the hinge to allow easy access to the interior of the container.

BRIEF DESCRIPTION OF THE DRAWINGS

Reference will now be made to the drawings wherein like parts are designated by like numerals, and wherein FIG. 1 is a perspective view of the device in accordance with the present invention.

FIG. 2 is a top view of the device of the present invention.

FIG. 3 is a cross sectional view taken along lines 3—3 of FIG. 2; and

FIG. 4 is a partially cross sectional view of the device of the present invention in use with a conventional household garbage bin.

DESCRIPTION OF THE PREFERRED EMBODIMENT

Referring now to the drawings in more detail, numeral 10 designates the device for compartmentalizing a container in accordance with the present invention.

As can be seen in the drawings, the device 10 comprises an elongated rigid bar 12 and a pair of transverse arms 14 and 16 which are hingedly attached, by hinges 18 and 20, respectively, in a substantially perpendicular relationship to the elongated bar 12.

The arms 14 and 16 are attached to the bar 12 at approximately a central portion of the bar 12, so that the arms 14 and 16 form a cross with the elongated bar 12. Both the bar 12 and the arms 14 and 16 are hollow in their interior and receive, in a telescopically sliding relationship, extension members 20, 22 and 24, 26, respectively. The extension members 20, 22, 24 and 26 have an exterior of substantially the same configuration as the interior of the bars 12 and the arms 14 and 16, and are dimensioned to frictionally slidingly engage within the bar 12 and the arms 14 and 16. The extension members 20 and 22 engage opposite open ends of the bar 12, as can be seen in FIG. 1. The extension members 20, 22, 24 and 26 allow to extend the bar 12 and the cross arms 14 and 16 to a greater length, on an average about five inches, so as to allow adapting the device 10 to use with various size disposal cans.

Outermost ends of the extension members 20, 22, 24, and 26 extend outwardly from the outermost edges of the elongated bar 12 and transverse arms 14 and 16. Each exteriorally extending end of the extension members carries a securing bolt 30 which passes through the vertical section of the extension members to the underside of the extension members. To prevent withdrawing of the bolt 30 from its engagement within an opening 32 formed in the extension members, a securing nut is engaged with the downwardly extending end of the bolt 30, thus securing position of the bolt 30 to the extension members.

Secured to each of the extension members 20, 22, 24 and 26 is a curved resilient flexible clip 38, one end of which contacts an upper surface 40 of the extension members, while the second end of which contacts the outermost end wall 42 of the extension members. The first end of the clip 38 is provided with an aperture substantially equal to the opening 32 in the extension member, so as to receive the bolt 30 therethrough.

At the second end the clip 38 is flexed in a spring-type fashion to frictionally contact the wall 42 but not to be attached thereto.

Each bolt 30 has a knob 44 on its topmost end, the knob 44 being on a slightly greater diameter than the elongated shank of the bolt 30. By pulling on the knob 44, the user can withdraw to the desired distance the extension members 20, 22, 24 and 26 from the telescopic engagement with bar 12 and the arms 14 and 16, respectively. The bolt 30 also prevents further sliding movement of the extension members into the engagement within their respective bar and arms. As such, the bolt 30, serves as a means for limiting sliding telescopic movement of the extension members inwardly towards the center of the device 10.

As is illustrated in FIG. 1, the arms 14 and 16 can be moved pivotaly, to a certain degree, in relation to the elongated bar 12. Although only one arm, arm 14 is shown in phantom line as moving on the hinge 18 in relation to the bar 12, it will be easily understood that the arm 16 can be moved in a likewise fashion.

Securedly attached to the bar 12 and to the arms 14 and 16 are second securing bolts 46 which pass through the vertical axis of the elongated bar 12 and arms 14 and 16 and are engaged on the bottommost surface of the bar 12 and arms 14 and 16 with a securing nut 48, similarly to the engagement of the securing nut (not shown) of the bolt 30. The bolts 46, likewise, assist in preventing movement of the extension members 20, 22, 24 and 26 towards the center of the device 10. As can be seen the drawings, a pair of bolts 46 are secured equidistantly from the bar 12 to serve as movement limiting means for the extension members 20 and 22. The bolts 46 are also provided with enlarged diameter knobs 48, as better seen in FIG. 3.

Although the device 10 is shown to comprise generally rectangularly shaped bar 12 and arms 14 and 16, as well as extension members 20, 22, 24 and 26, it will be apparent to those skilled in the art that other desired shapes and cross sections of the members can be successfully employed for the purposes herein described. The device 10 can be manufactured from a lightweight, sufficiently strong material, such as aluminum, sturdy plastic and the like. The basic requirement being that the bar 12 and the arms 14 and 16 withstand the weight of a fully loaded garbage bags which are suspended therefrom.

In operation, the user positions the device 10 above the open top end of a garbage can 50 and approximately centers the device 10 over the center of the bin 50. If necessary, the extension members 20, 22, 24 and 26 are pulled outwardly to an extent sufficient for the clips 38 to engage the outer continuous wall 52 of the garbage bin 50. In such a manner, the device 10 is suspended by four clips 38 from the top edge of the bin 50, allowing the bar 12 and the arms 14 and 16 to divide the open chamber formed by the interior wall 54 of the garbage bin 50 into four equal compartments. Two or more garbage bags 58 are then attached to the device 10, such that the bag itself is pushed into the chamber 56 of the garbage can 50, while the open end of the garbage bags 58 is stretched between knobs 30 of adjacent arm 14 or 16 and that portion of the elongated bar 12 which forms a right angle therewith, and on the bolts 46 secured to those respective arm and bar portions.

Since the garbage bags 58 are traditionally formed from a stretchable thin plastic, they are forced onto the knobs 44 and 48 of the bolts 30 and 46, respectively, until an opening is formed in the top end of the bag to force the bag over the knob and downwardly, to the upwardly extending portion of the bolt 30 or 46. The bag thus becomes suspended from four bolts, two of them positioned adjacent the center of the device 10 and two of them being at perpendicularly located points on the portion of the bar 12 and one of the arms 14 or 16. In a similar manner, other bags are positioned within the allocated compartments, allowing the body of the bag to be suspended from the device 10 downwardly.

The consumer is now provided with four garbage bags to allow easy disposal of particular type articles into a specified bag, so that each category of a disposable item is disposed into one particular bag.

Once one or more of the garbage bags become full, one of the arms 14 or 16 is pushed upwardly, forcing the clip 38 from its resilient frictionally engagement with a wall 52 of the garbage can 50. The clip 38 is then moved upwardly and disengages one of the arms from its fixed engagement with the can 50. The top of the garbage bag is released from its engagementwith the knobs 30 and 46, while the arm 14 or 16 is pivoted further, opening access to the open top of the garbage can 50 and allowing withdrawal of a full garbage bag 58. In a similar manner, other garbage bags are removed from the garbage bin 50, the bags now containing a specified category of a recyclable material, such as paper, aluminum cans, glass jars and bottles, etc. The recyclable material is disposed of in the usual manner by bringing it to a recycling center or by allowing municipal waste disposable service to pick up the recyclable items in accordance with the existing program.

The arm 14 and 16, which has been pivoted to allow withdrawal of the garbage bag is lowered again and a new garbage bag is stretched on the arm and the bar 12 for subsequent use.

While the device of the present invention was described in relation to a household garbage bin 50, it will be easily understood that such device can be used for municipal waste containers, encouraging citizens to save recyclable items, instead of disposing of them.

Many changes and modifications can be made within the design of the present invention without departing from the spirit thereof.

I, therefore, pray that my rights to the present invention be limited only by the scope of the appended claims.

I Claim:

1. A device for compartmentalizing a container comprising:

an elongated bar having a hollow interior; and a pair of transverse arms, each secured to opposite sides of a middle portion of the elongated bar at a right angle to a longitudinal axis of the elongated bar, each arm being adapted for a pivotal movement in relation to the elongated bar, said elongated bar and each of said transverse arms being provided with an extension means for extending longitudinal dimensions of said bar and said transverse arms, said extension means comprising an extension member telescopically slidingly engaged within outer open ends of said elongated bar and said transverse arms.

2. The device of claim 1, wherein said elongated bar and each of said transverse arms is provided with an extension means for extending longitudinal dimensions of said bar and said transverse arms.

3. The device of claim 2, wherein said extension means comprises an extension member telescopically slidingly engaged within outer open ends of said elongated bar and said transverse arms.

4. The device of claim 1, wherein each of said extension members is provided with means for limiting sliding movement of the extension member.

5. The device of claim 4, wherein said means for limiting sliding movement comprise a transverse bolt extending perpendicularly to a longitudinal axis of the extension member.

6. The device of claim 1, wherein each of said extension members is provided with means for securing said device to a top rim of the container.

7. A device for compartmentalizing a container, comprising:

an elongated bar having a hollow interior;

a pair of transverse arms, each secured to opposite sides of a middle portion of the elongated bar at a right angle to a longitudinal axis of the elongated bar, each arm being adapted for a pivotal movement in relation to the elongated bar, said elongated bar and each of said transverse arms being provided with an extension means for extending longitudinal dimensions of said bar and said transverse arms, said extension means comprising an extension member telescopically slidingly engaged within outer open ends of said elongated bar and said transverse arms;

said extension members being provided with means for securing said device to a top rim of the container and, wherein said securing means comprise a curved flexible resilient clip attached to the extension member adjacent to an outermost end thereof.

8. The device of claim 7, wherein said clip comprises a first portion which is fixedly attached to a top surface of the extension member and a second portion which depends downwardly from said first portion and frictionally contacts an outermost end surface of the extension member.

9. The device of claim 1, wherein each of said transverse arms is hingedly attached to a middle portion of the elongated bar to allow a limited movement of said transverse arms in relation to the longitudinal bar.

10. A device for compartmentalizing a container, comprising:

an elongated bar having a hollow interior;

a pair of transverse arms, each secured to opposite sides of a middle portion of the elongated bar at a right angle to a longitudinal axis of the elongated bar, each arm being adapted for a pivotal movement in relation to the elongated bar, said elongated bar and each of said transverse arms being provided with an extension means for extending longitudinal dimensions of said bar and said transverse arms, said extension means comprising an extension member telescopically slidingly engaged within outer open ends of said elongated bar and said transverse arms, wherein each of said extension members is provided with a primary means for limiting sliding movement of the extension member; and, wherein said elongated bar and said transverse arms carry secondary means for limiting sliding movement of the extension members.

11. The device of claim 10, wherein said secondary means for limiting sliding movement comprise a plurality of bolts attached to said elongated bar and said transverse arms adjacent the middle portion of the elongated bar and inner ends of the transverse arms, respectively.

12. A device for compartmentalizing a container, comprising:

an elongated bar having a hollow interior and open opposite ends;

a pair of transverse arms each secured to opposite sides of a middle portion of the elongated bar at a right angle to a longitudinal axis of the elongated bar, each arm being adapted for a limited pivotal movement in relation to the elongated bar;

extension means for extending longitudinal dimensions of said bar and said transverse arms carried by outermost ends of said elongated bar and said transverse arms, wherein said extension means comprises an extension member telescopically engaged within opposite open ends of said elongated bar and outermost open ends of said transverse arms; and means for securing said device to a top rim of the container.

13. The device of claim 12, wherein each of said extension members is provided with means for limiting sliding movement of the extension members.

14. The device of claim 13, wherein said means for limiting sliding movement comprise a transverse bolt extending perpendicularly to a longitudinal axis of the extension member, through said extension member.

15. A device for compartmentalizing a container, comprising:

an elongated bar having a hollow interior and open opposite ends;

a pair of transverse arms, each secured to opposite sides of a middle portion of the elongated bar at a right angle to a longitudinal axis of the elongated bar, each arm being adapted for a limited pivotal movement in relation to the elongated bar;

extension means for extending longitudinal dimensions of said bar and said transverse arms carried by outermost ends of said elongated bar and said transverse arms; and means for securing said device to a top rim of the container, wherein said means for securing the device to a top rim of the container comprise a curved flexible resilient clip attached to each of the extension members adjacent to an outermost end of said extension member.

16. The device of claim 15, wherein said clip comprises a first portion which is fixedly attached to a top surface of the extension member and a second portion which depends downwardly from said first portion and frictionally contacts an outermost end surface of the extension member.

17. The device of claim 12, wherein each of said transverse arms is hingedly attached to a middle portion of the elongated bar to allow a limited pivotal movement of said transverse arm in relation to the elongated bar.

* * * * *